US008237342B2

(12) United States Patent
Yamamura et al.

(10) Patent No.: US 8,237,342 B2
(45) Date of Patent: Aug. 7, 2012

(54) PLASMA JET IGNITION PLUG AND MANUFACTURING METHOD THEREOF

(75) Inventors: Naofumi Yamamura, Nagoya (JP); Hiroyuki Kameda, Aichi-ken (JP); Daisuke Nakano, Kiyosu (JP); Daisuke Kasahara, Toyoake (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/239,891

(22) Filed: Sep. 22, 2011

(65) Prior Publication Data

US 2012/0080995 A1 Apr. 5, 2012

(30) Foreign Application Priority Data

Oct. 5, 2010 (JP) ..... 2010-225315

(51) Int. Cl.
*H01T 13/20* (2006.01)

(52) U.S. Cl. ..... 313/141; 313/139; 445/7

(58) Field of Classification Search ..... 313/118–145; 123/32, 41, 143 R, 146.5 R, 169 P, 260, 280, 123/169 R, 169 EL, 310; 445/7
See application file for complete search history.

(56) References Cited

U.S. PATENT DOCUMENTS 7,305,954 B2 12/2007 Hagiwara et al. ..... 123/143
7,328,677 B2 2/2008 Hagiwara et al. ..... 123/143

FOREIGN PATENT DOCUMENTS

JP 2007-287666 11/2007

*Primary Examiner* — Mariceli Santiago
*Assistant Examiner* — Donald Raleigh
(74) *Attorney, Agent, or Firm* — Kusner & Jaffe

(57) ABSTRACT

A plasma jet ignition plug that reliably prevents current leakage with restraint on variation in the position of a ground electrode relative to an insulator and on overheat of the ground electrode, for stable generation of plasma. The plug includes an insulator having an axial bore extending in the direction of an axis CL1, a center electrode inserted in the axial bore, a metallic shell disposed externally of the outer circumference of the insulator, and a ground electrode fixed to the metallic shell, and has a cavity defined by the wall surface of the axial bore and the front end surface of the center electrode. Supports intervene between the insulator and the ground electrode. A space formed radially outward of the supports and a space formed radially inward of the support communicate with each other.

11 Claims, 12 Drawing Sheets

PLASMA JET IGNITION PLUG AND MANUFACTURING METHOD THEREOF

FIELD OF THE INVENTION

The present invention relates to a plasma jet ignition plug for igniting an air-fuel mixture through formation of plasma and to a method of manufacturing the plasma jet ignition plug.

BACKGROUND OF THE INVENTION

Conventionally, a combustion apparatus, such as an internal combustion engine, uses a spark plug for igniting an air-fuel mixture through spark discharge. In recent years, in order to meet demand for high output and low fuel consumption of the combustion apparatus, a plasma jet ignition plug has been proposed, since the plasma jet ignition plug provides quick propagation of combustion and can more reliably ignite even a lean air-fuel mixture having a higher ignition-limit air-fuel ratio.

The plasma jet ignition plug includes a tubular insulator having an axial bore, a center electrode inserted into the axial bore in such a manner that a front end surface thereof is retracted from a front end surface of the insulator, a metallic shell disposed externally of the outer circumference of the insulator, and an annular ground electrode joined to a front end portion of the metallic shell. Also, the plasma jet ignition plug has a space (cavity) defined by the front end surface of the center electrode and a wall surface of the axial bore. The cavity communicates with an ambient atmosphere via a through hole (through hole portion) formed in the ground electrode. Additionally, generally, the ground electrode is provided in such a condition that its surface on a side toward the insulator is in surface contact with the front end surface of the insulator. For example, see Japanese Patent Application Laid-Open (kokai) No. 2007-287666, "Patent Document 1").

SUMMARY OF THE INVENTION

Problems to be Solved by the Invention

In the course of use, deposits, such as carbon which enters the cavity, and electrically conductive substances, such as metal components of the center electrode, may accumulate on or adhere to a wall surface of the axial bore. When, as mentioned above, the ground electrode is in surface contact with the front end surface of the insulator, the following risk is involved: the electrically conductive substances establish an electrical connection between the center electrode and the ground electrode. As a result, current leaks between the electrodes, thereby hindering generation of plasma.

Thus, in order to prevent such a current leakage for stable generation of plasma, a conceivable method is to join the ground electrode to the metallic shell in such a condition as to be separated from the front end surface of the insulator by providing a space between the ground electrode and the front end surface of the insulator. Employment of this method can restrain accumulation of the electrically conductive substances and can insulate the two electrodes from each other through existence of the space even when the electrically conductive substances adhere to the wall surface of the axial bore.

However, manufacturing variations, for example, may cause some variation in the position of the insulator relative to the metallic shell along the axial direction. Thus, in the case where the ground electrode is joined to the metallic shell in such a condition as to be separated from the front end surface of the insulator, in association with the variation in the relative position of the insulator, variation arises in the position of the ground electrode relative to the insulator, potentially resulting in a change in the size of the space along the axial direction. The change of the size of the space may cause insufficient insulation between the two electrodes or an increase in discharge voltage required for generation of spark discharge which triggers generation of plasma.

Also, when the ground electrode is separated from the insulator, heat of the ground electrode is not transferred to the insulator. As a result, the ground electrode is overheated, potentially resulting in occurrence of preignition with the ground electrode serving as a heat source.

The present invention has been conceived in view of the above circumstances, and an object of the invention is to provide a plasma jet ignition plug in which, with restraint on variation in the position of a ground electrode relative to an insulator and on overheat of the ground electrode, current leakage between a center electrode and the ground electrode is reliably prevented for stable generation of plasma, as well as a method of manufacturing the plasma jet ignition plug.

Means for Solving the Problems

Configurations suitable for achieving the above object will next be described in itemized form. If needed, actions and effects peculiar to the configurations will be described additionally.

Configuration 1: A plasma jet ignition plug of the present configuration comprises an insulator having an axial bore extending in a direction of an axis; a center electrode inserted in the axial bore in such a manner that a front end thereof is located rearward of a front end of the insulator with respect to the direction of the axis; a metallic shell disposed externally of an outer circumference of the insulator; and a ground electrode fixed to a front end portion of the metallic shell and disposed frontward of the front end of the insulator with respect to the direction of the axis. A cavity is defined by a wall surface of the axial bore and a front end surface of the center electrode. The ground electrode has a through hole portion for allowing the cavity to communicate with an ambient atmosphere. The plasma jet ignition plug further comprises a support intervening between a front end surface of the insulator and a surface of the ground electrode located on a side toward the insulator. A space formed radially outward of the support and a space formed radially inward of the support communicate with each other. As viewed on an imaginary plane which is orthogonal to the axis and onto which an opening of the axial bore located on a front side with respect to the direction of the axis and the support are projected, a point A which is on an outline of the support such that a distance to the axis therefrom is the shortest distance between the outline of the support and the axis is located radially outward of an outline of the opening of the axial bore.

According to the above configuration 1, since the support intervenes between the front end surface of the insulator and the surface of the ground electrode located on the side toward the insulator, heat of the ground electrode can be efficiently transferred to the insulator. Thus, overheat of the ground electrode can be reliably prevented, whereby occurrence of preignition can be restrained.

Also, for example, by means of the support being provided uncontinuously in the circumferential direction, a space formed radially outward of the support and a space formed radially inward of the support (a space on a side toward the cavity) communicate with each other. Accordingly, deposits which have entered the cavity can be discharged to the space formed radially outward of the support, whereby current leakage between the center electrode and the ground electrode can be reliably prevented.

Furthermore, according to the above configuration 1, as viewed on an imaginary plane which is orthogonal to the axis and onto which the opening of the axial bore and the support are projected along the axis, the point A which is on the outline of the support such that the distance to the axis therefrom is the shortest distance between the outline of the support and the axis is located radially outward of the outline of the opening of the axial bore. That is, an annular space is formed on a radially inner side of the support between the front end surface of the insulator and the side of the ground electrode located on the side toward the insulator. Also, by virtue of the existence of the support, the ground electrode can be disposed accurately at a desired position relative to the front end surface of the insulator, whereby variation in the size of the space can be effectively prevented. Therefore, even when electrically conductive substances, such as metal components of the center electrode, adhere to the wall surface of the axial bore, by virtue of the existence of the space, electrical insulation is reliably established between the center electrode and the ground electrode. As a result, coupled with the effect that deposits can be discharged to the space formed radially outward of the support, current leakage between the center electrode and the ground electrode can be effectively prevented. Therefore, plasma can be stably generated.

Additionally, according to the above configuration 1, in association with existence of the aforementioned space, a spark discharge is generated along a path creeping on the inner circumferential surface of the insulator from the front end surface of the center electrode to the opening of the axial bore (a creeping discharge path) and along a path in gas (in other words, across the space) from the opening of the axial bore to the ground electrode (a gaseous discharge path). The spark discharge causes generation of plasma. Through generation of discharge along the gaseous discharge path (gaseous discharge), plasma can be generated without existence of obstruction to expansion of plasma. As a result, larger plasma can be generated, whereby ignition performance can be improved. That is, the provision of the space contributes to both stable generation of plasma and the improvement of ignition performance.

Configuration 2: A plasma jet ignition plug of the present configuration is characterized in that, in the above configuration 1, as viewed on a plane which is orthogonal to the axis and onto which the support is projected along the axis, two straight lines being tangent to the projected support and passing the axis form an angle $\alpha$(°) therebetween on a side toward the projected support, and the angle $\alpha$ satisfies a relational expression $\alpha/360° \leqq 0.5$.

In the case where a plurality of the supports are provided, the "angle $\alpha$" is the sum of angles each being formed on a side toward the corresponding projected support by the two straight lines tangent to the projected support.

According to the above configuration 2, as viewed about the axis from a position on the axis corresponding to the support, the support is formed over a circumferential range of 50% or less. That is, as viewed about the axis from the position on the axis, a space formed radially inward of the support and a space formed radially outward of the support communicate with each other over a circumferential range of more than 50%. Thus, deposits can be more effectively discharged to the space formed radially outward of the support, so that current leakage can be more reliably prevented.

Configuration 3: A plasma jet ignition plug of the present configuration is characterized in that, in the above configuration 1 or 2, as viewed on a section which contains the axis and the point A, relational expressions $0.1 \leqq H \leqq 1.0$ and $L \geqq 1.5 \times H$ are satisfied, where H (mm) is the shortest distance between the front end surface of the insulator (2) and a point closest to the axis on the surface of the ground electrode located on the side toward the insulator, and L (mm) is the shortest distance between the point A and the opening of the axial bore located on the front side with respect to the direction of the axis.

According to the above configuration 3, the shortest distance H is specified to be 0.1 mm or more. Thus, even when electrically conductive substances adhere to the wall surface of the axial bore in the course of use, electrical insulation can be more reliably established between the center electrode and the ground electrode. Also, since the shortest distance L is sufficiently large; specifically, 1.5 times or more the shortest distance H, current leakage which would otherwise creep on the inner circumferential surface and the front end surface of the insulator between the center electrode and the support can be more reliably prevented. As a result, plasma can be more reliably generated.

Also, since the shortest distance H is specified to be 1.0 mm or less, discharge voltage required for generation of spark discharge can be sufficiently lowered. Thus, a phenomenon that spark discharges erode the inner circumferential surface of the insulator (so-called channeling) can be restrained. Also, spark discharge can be more reliably generated. Eventually, plasma can be more stably generated. Furthermore, the employment of a shortest distance H of 1.0 mm or less restrains entry of generated plasma into the aforementioned space. As a result, the above-mentioned effect of improving ignition performance can be more reliably exhibited.

Configuration 4: A plasma jet ignition plug of the present configuration is characterized in that, in any one of the above configurations 1 to 3, the support satisfies a relational expression $S \geqq 0.04$, where S ($mm^2$) is a cross-sectional area of the support taken orthogonally to the axis at a position located 0.05 mm away along the axis from the front end surface of the insulator.

In the case where a plurality of the supports are provided, the "cross-sectional area S" is the sum of cross-sectional areas each being of the corresponding support as measured at a position located 0.05 mm away from the front end surface of the insulator.

As mentioned above, heat of the ground electrode is transferred to the insulator via the support. In this connection, the inventors of the present invention carried out extensive studies and found the following: even though a portion of the support which is located up to 0.05 mm away along the axis from the front end surface of the insulator is not in contact with the insulator, the portion of the support can transfer heat to the insulator in the form of radiation heat.

In view of this point, according to the above configuration 4, the support has a sufficiently large cross-sectional area S of 0.04 $mm^2$ or more as measured at a position located 0.05 mm away along the axis from the front end surface of the insulator. Thus, heat of the ground electrode can be more efficiently transferred to the insulator via the support. As a result, the occurrence of preignition can be more reliably prevented.

Also, through employment of a cross-sectional area S of 0.04 $mm^2$ or more, in the course of manufacture of an ignition plug, when the support is brought into contact with the front end surface of the insulator, a problematic situation that the support is excessively crushed and deformed can be reliably prevented. As a result, the above-mentioned shortest distances H and L can be readily set to respectively desired values.

Configuration 5: A plasma jet ignition plug of the present configuration is characterized in that, in any one of the above configurations 1 to 4, a plurality of the supports are provided.

According to the above configuration 5, the ground electrode is disposed more stably relative to the insulator, so that the above configurations more reliably yield actions and effects peculiar thereto.

Configuration 6: A plasma jet ignition plug of the present configuration is characterized in that, in the above configuration 5, the supports are provided at circumferentially equal intervals.

According to the above configuration 6, the supports are provided at circumferentially equal intervals. In other words, gaps which are formed between the supports and adapted to establish communication between a space formed radially inward of the supports and a space formed radially outward of the supports are provided at circumferentially equal intervals. Thus, deposits can be more effectively discharged to the space formed radially outward of the supports, so that current leakage can be more reliably prevented.

Configuration 7: A plasma jet ignition plug of the present configuration is characterized in that, in any one of the above configurations 1 to 6, the ground electrode is formed of tungsten (W), iridium (Ir), platinum (Pt), nickel (N), or an alloy which contains at least one of the metals as a main component.

The term "main component" indicates a component of material having the highest mass ratio.

According to the above configuration 7, the ground electrode is formed of a metal which contains at least one of W, Ir, etc., as a main component. Thus, erosion resistance of the ground electrode against spark discharges or the like can be improved. As a result, an increase in discharge voltage associated with erosion of the ground electrode can be restrained, whereby a period in which plasma can be generated can be elongated.

Configuration 8: A plasma jet ignition plug of the present configuration is characterized in that, in any one of the configurations 1 to 7, the support(s) is formed integral with the ground electrode or with the insulator.

According to the above configuration 8, the support(s) is formed integral with the ground electrode or with the insulator. Thus, misalignment of the support(s) relative to the ground electrode and to the insulator can be prevented. As a result, the above configurations can more reliably yield actions and effects peculiar thereto.

Configuration 9: A method of manufacturing a plasma jet ignition plug of the present configuration is a method of manufacturing a plasma jet ignition plug described in any one of the above configurations 1 to 8 and comprises an assembling step of assembling the insulator and the metallic shell together, and a joining step of joining the ground electrode to the front end portion of the metallic shell. The joining step is performed after the assembling step.

The joining step of joining the ground electrode to the front end portion of the metallic shell can be performed before or after the assembling step of assembling the metallic shell and the insulator together. However, performing the joining step before the assembling step involves the following risk: in the case where variation in the position of the insulator relative to the metallic shell arises due to manufacturing variations, etc., the insulator is pressed against the support(s) and thus breaks, or is disposed away from the support(s).

By contrast, according to the above configuration 9, the joining step is performed after the assembling step. Thus, in the joining step, the position of the ground electrode relative to the insulator can be adjusted. Therefore, the support(s) can be more reliably brought into contact with the front end surface of the insulator, while breakage of the insulator is prevented. As a result, the ignition plug according to the above configuration 1, etc., can be accurately manufactured, while a drop in yield is restrained.

Configuration 10: A method of manufacturing a plasma jet ignition plug of the present configuration is characterized in that, in the above configuration 9, the joining step comprises a step of joining the support(s) to the surface of the ground electrode located on the side toward the insulator and a step of inserting the ground electrode into an opening formed in a front end portion of the metallic shell until the support(s) comes into contact with the front end surface of the insulator, and then joining the ground electrode to the front end portion of the metallic shell, and a relational expression $Hi > Hg \geqq Hs$ is satisfied, where Hi is hardness of the insulator, Hg is hardness of the ground electrode, and Hs is hardness of the support (s).

According to the above configuration 10, the hardness Hi of the insulator is rendered higher than the hardness Hs of the support(s). Thus, in a step (inserting step) of inserting the ground electrode into the opening of the metallic shell, when the support(s) comes into contact with the front end surface of the insulator and imposes a pressing force on the insulator, the insulator is unlikely to suffer breakage, such as cracking.

Also, according to the above configuration 10, the hardness Hg of the ground electrode is rendered equal to or higher than the hardness Hs of the support(s). Thus, in the inserting step, the problem that the proximal end of the support(s) digs (thrusts) into the ground electrode can be more reliably prevented. As a result, the breakage of the weld zone between the ground electrode and the support(s) can be restrained, so that misalignment of the support(s) relative to the insulator and the ground electrode can be more reliably prevented.

Configuration 11: A method of manufacturing a plasma jet ignition plug of the present configuration is characterized in that, in the above configuration 9 or 10, the joining step comprises a step of forming the support(s) on the surface of the ground electrode located on the side toward the insulator and a step of inserting the ground electrode into an opening formed in a front end portion of the metallic shell until the support(s) comes into contact with the front end surface of the insulator, and then joining the ground electrode to the front end portion of the metallic shell, and, before the joining step, a cross-sectional area of the support(s) as measured at a position located toward the insulator is equal to or smaller than a cross-sectional area of the support(s) as measured at a position located toward the ground electrode.

According to the above configuration 11, before the joining step, the cross-sectional area of the support(s) as measured at a position located toward the insulator is equal to or smaller than the cross-sectional area of the support(s) as measured at a position located toward the ground electrode. Thus, when a portion of the support(s) in contact with the insulator is crushed and deformed, excessive approach of the portion toward the cavity is unlikely to arise. As a result, in a manufactured ignition plug, the aforementioned shortest distance L can assume a sufficiently large value, so that current leakage between the support(s) and the center electrode can be more reliably restrained.

DETAILED DESCRIPTION OF THE INVENTION

Figure 1:
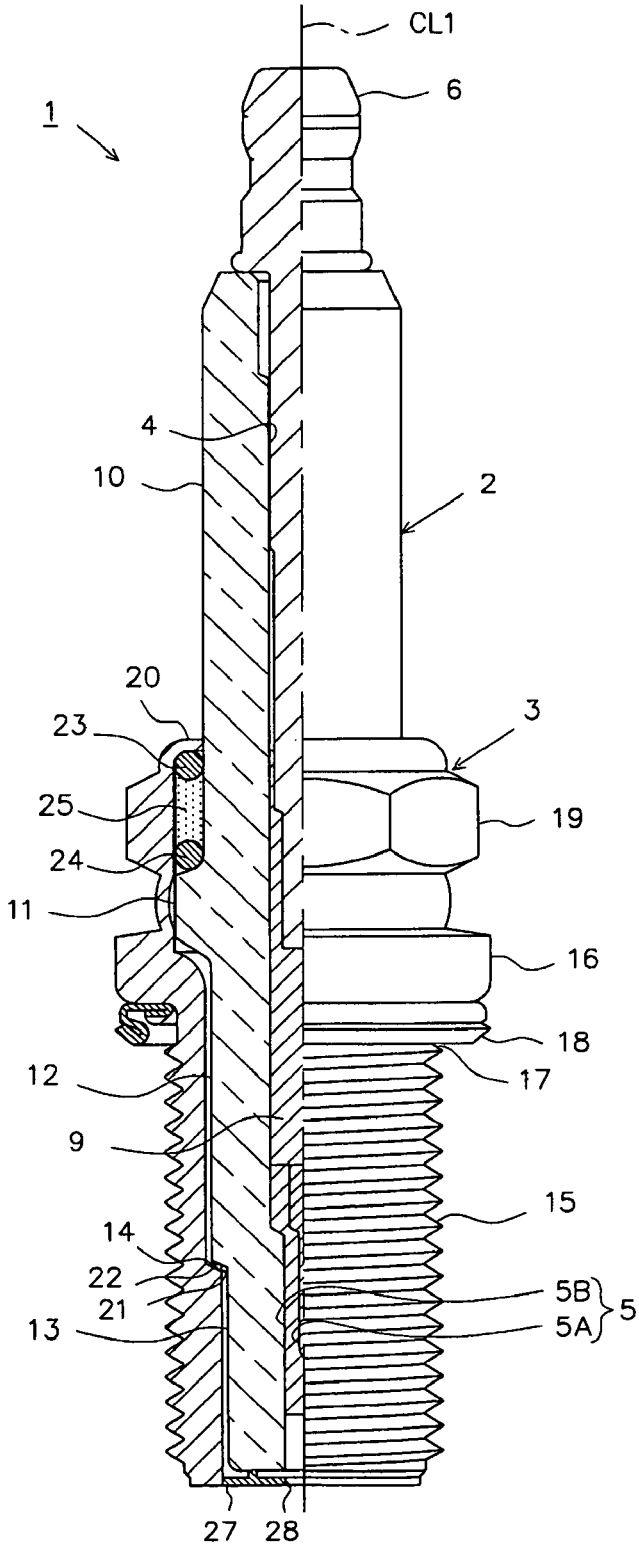
FIG. 1 is a partially cutaway front view showing the configuration of an ignition plug.

An embodiment of the present invention will next be described with reference to the drawings. FIG. 1 is a partially cutaway front view showing a plasma jet ignition plug (hereinafter, referred to as the "ignition plug") 1. In the following description, the direction of an axis CL1 of the ignition plug 1 in FIG. 1 is referred to as the vertical direction in FIG. 1, and the lower side of FIG. 1 is referred to as the front side of the ignition plug 1, and the upper side of FIG. 1 is referred to as the rear side of the ignition plug 1.

The ignition plug 1 includes a tubular insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. Additionally, the large-diameter portion 11, the intermediate trunk portion 12, and the leg portion 13 of the insulator 2 are accommodated within the metallic shell 3. A tapered, stepped portion 14 is formed at a connection portion between the intermediate trunk portion 12 and the leg portion 13. The insulator 2 is seated, at the stepped portion 14, on the metallic shell 3.

Furthermore, the insulator 2 has an axial bore 4 extending therethrough along the axis CL1. A center electrode 5 is fixedly inserted into a front end portion of the axial bore 4. The center electrode 5 is composed of an inner layer 5A made of, for example, copper or a copper alloy, which has excellent thermal conductivity, and an outer layer 5B made of a nickel alloy (e.g. INCONEL 600 or 610 (trade name)) which contains nickel (Ni) as a main component. Furthermore, the center electrode 5 assumes a rodlike (circular columnar) shape as a whole. The front end of the center electrode 5 is disposed rearward of the front end surface of the insulator 2. In order to improve erosion resistance of the center electrode 5, a front end portion of the center electrode 5 (e.g., a portion of the center electrode 5 which extends rearward along the direction of the axis CL1 up to at least 0.3 mm from the front end of the center electrode 5) may be formed of tungsten (W), iridium (Ir), platinum (Pt), nickel (Ni), or an alloy which contains at least one of the metals as a main component.

Also, a terminal electrode 6 is fixedly inserted into a rear end portion of the axial bore 4 and projects from the rear end of the insulator 2.

A circular columnar glass seal layer 9 is disposed within the axial bore 4 between the center electrode 5 and the terminal electrode 6. By means of the glass seal layer 9, the center electrode 5 and the terminal electrode 6 are electrically connected to each other and are fixed to the insulator 2.

Additionally, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the metallic shell 3 is to be mounted to the combustion apparatus. Also, the metallic shell 3 has a crimp portion 20 provided at a rear end portion thereof for retaining the insulator 2.

Also, the metallic shell 3 has, on its inner circumferential surface, a tapered, stepped portion 21 adapted to allow the insulator 2 to be seated thereon. The insulator 2 is inserted into the metallic shell 3. In a state in which the stepped portion 14 of the insulator 2 butts against the stepped portion 21 of the metallic shell 3, a rear-end opening portion of the metallic shell 3 is crimped radially inward; i.e., the crimp portion 20 is formed, whereby the insulator 2 is fixed to the metallic shell 3. An annular sheet packing 22 intervenes between the stepped portions 14 and 21 of the insulator 2 and the metallic shell 3, respectively. This retains gastightness of a combustion chamber and prevents outward leakage of fuel gas through a gap between the leg portion 13 of the insulator 2 and the inner circumferential surface of the metallic shell 3.

Furthermore, in order to ensure gastightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the insulator 2 via the sheet packing 22, the ring members 23 and 24, and the talc 25.

Figure 2:
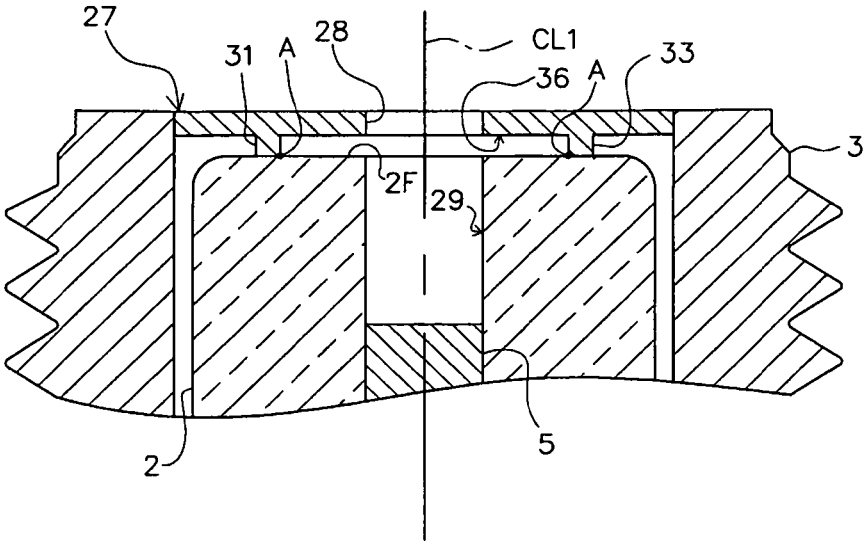
FIG. 2 is an enlarged, fragmentary, sectional view showing the configuration of a front end portion of the ignition plug.

Also, a disklike ground electrode 27 having a predetermined thickness (e.g., 0.3 mm to 1.00 mm inclusive) is joined to the inner circumference of a front end portion of the metallic shell 3. The ground electrode 27 has a through hole portion 28 extending therethrough in the direction of thickness thereof at the center thereof. As shown in FIG. 2, a cavity 29 is a circular columnar space which opens frontward; is defined by the wall surface of the axial bore 4 and the front end surface of the center electrode 5; and communicates with the ambient atmosphere via the through hole portion 28. In the present embodiment, the ground electrode 27 is joined to the metallic shell 3 in such a manner that the through hole portion 28 and the axial bore 4 are coaxial with each other (i.e., the center of the through hole portion 28 is located on the axis CL1).

Figure 3:
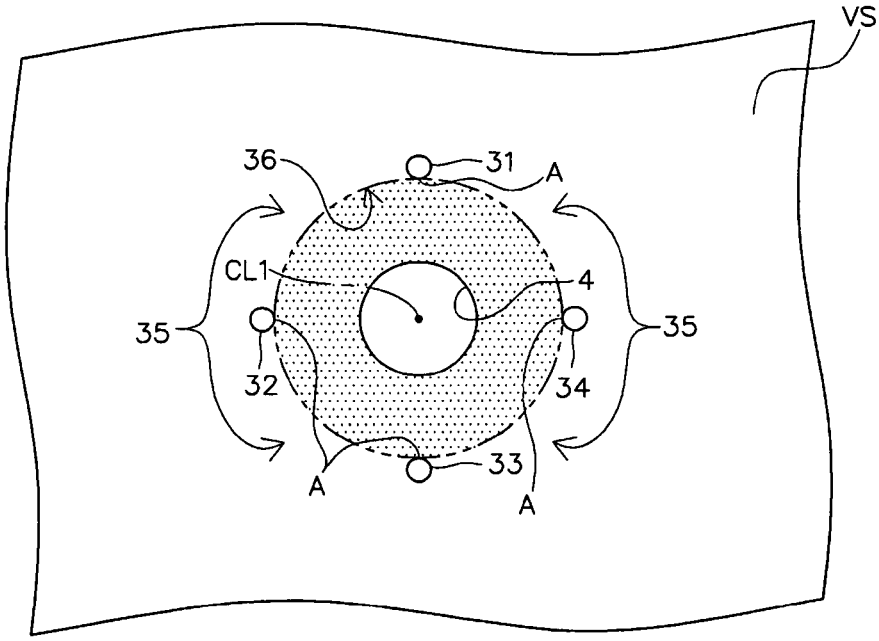
FIG. 3 illustrates a projected plan in which an axial bore and a support are projected along an axis onto an imaginary plane orthogonal to the axis.
Figure 4:
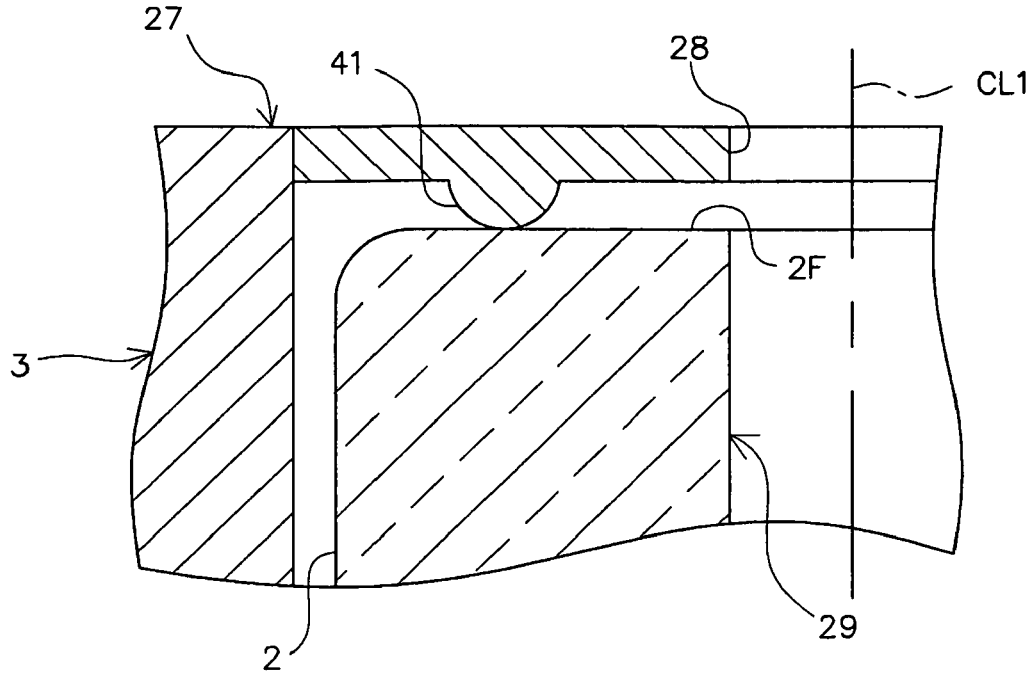
FIG. 4 is an enlarged, fragmentary, sectional view showing another example of the support.

Furthermore, in the present embodiment, as shown in FIGS. 2 and 3 (FIG. 3 is a projected plan in which the opening of the axial bore 4 located on the front side with respect to the direction of the axis CL1 and supports 31 to 34, which will be described later, are projected along the axis CL1 onto an imaginary plane VS orthogonal to the axis CL1), a plurality of the supports 31, 32, 33, and 34 are provided between a front end surface 2F of the insulator 2 and the surface of the ground electrode 27 located on a side toward the insulator 2. Each of the supports 31 to 34 has a circular columnar shape and is welded at its proximal end to the surface of the ground electrode 27 located on the side toward the insulator 2, whereby the supports 31 to 34 are formed integral with the ground electrode 27. The supports 31 to 34 are provided at circumferentially equal intervals. As a result, a plurality of gaps 35 are formed between the supports 31 to 34 at circumferentially equal intervals. A space formed radially outward of the supports 31 to 34 and a space formed radially inward of the supports 31 to 34 (a space located on a side toward the cavity 29) communicate with each other through the gaps 35. The shape of the supports 31 to 34 is not limited to a circular columnar shape. For example, as shown in FIG. 4, a support 41 may be formed into a hemispheric shape.

Referring back to FIGS. 2 and 3, in the present embodiment, as viewed on the imaginary plane VS, a point A which is on the outline of each of the supports 31 to 34 such that a distance to the axis CL1 therefrom is the shortest distance between the outline of each of the supports 31 to 34 and the axis CL1 is located radially outward of the outline of the opening of the axial bore 4 located on the front side with respect to the direction of the axis CL1. That is, an annular space 36 (in FIG. 3, a dotted space) which communicates with the cavity 29 is formed radially inward of the supports 31 to 34 between the insulator 2 and the ground electrode 27. Thus, when voltage is applied to the center electrode 5, a spark discharge is generated along a path creeping on the inner circumferential surface of the insulator 2 from the front end surface of the center electrode 5 to the opening of the cavity 29 (the opening of the front end of the axial bore 4) (a creeping discharge path) and along a path in gas (in other words, across the space 36) from the opening of the cavity 29 to the ground electrode 27 (a gaseous discharge path). The spark discharge triggers generation of plasma. In the present embodiment, the supports 31 to 34 have the same shortest distance to the axis CL1 along a direction orthogonal to the axis CL1. Thus, as viewed on the imaginary plane VS, points on the respective outlines of the supports 31 to 34 which are closest to the axis CL1 are the points A.

Figure 5:
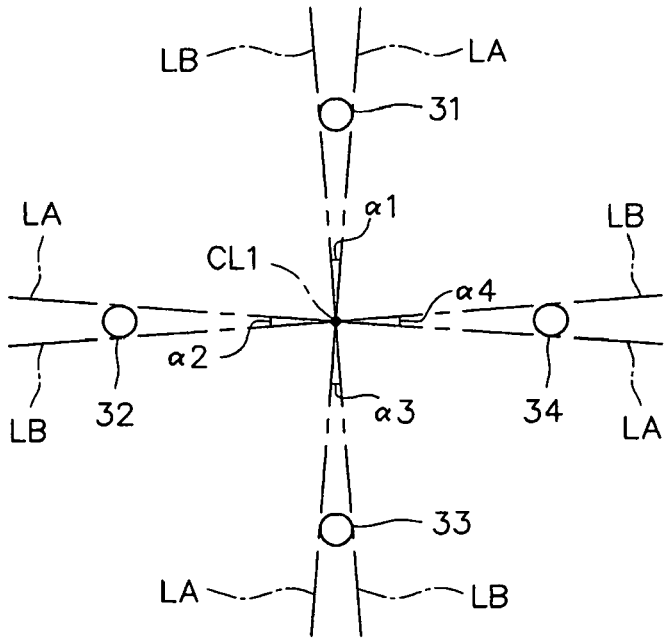
FIG. 5 illustrates a projected plan in which the supports are projected along the axis onto a plane orthogonal to the axis.

Also, the gaps between the supports 31 to 34 are set so as to satisfy the following condition. As shown in FIG. 5, on a plane of projection which is orthogonal to the axis CL1 and onto which the supports 31 to 34 are projected, two straight lines LA and LB are drawn in such a manner as to pass the axis CL1 and to be tangent to each of the projected supports 31 to 34. Angles formed by the straight lines LA and LB on a side toward the supports 31 to 34 are represented by $\alpha 1(°)$, $\alpha 2(°)$, $\alpha 3(°)$, and $\alpha 4(°)$, respectively. The gaps between the supports 31 to 34 are determined so as to satisfy the relational expression $\alpha\ (=\alpha 1+\alpha 2+\alpha 3+\alpha 4)/360° \leqq 0.5$. That is, as viewed about the axis CL1 from a position on the axis CL1 corresponding to the supports 31 to 34, the gaps 35 are formed over a circumferential range of more than 50%. In the following description, "$\alpha/360°$" is referred to as the "support angular ratio."

Figure 6:
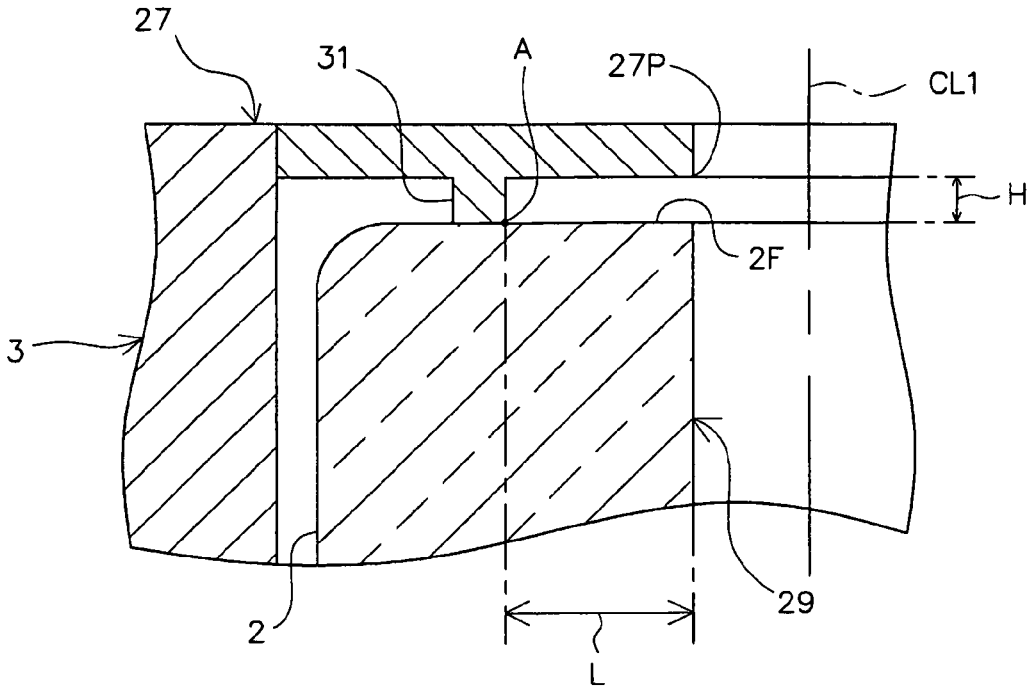
FIG. 6 is an enlarged, fragmentary, sectional view showing shortest distance H, shortest distance L, etc.

Additionally, as shown in FIG. 6, as viewed on a section which contains the axis CL1 and the point A, H (mm) represents the shortest distance between the front end surface 2F of the insulator 2 and a point 27P closest to the axis CL1 on the surface of the ground electrode 27 located on the side toward the insulator 2, and L (mm) represents the shortest distance between the support 31 (the point A) and the opening of the axial bore 4 located on the front side with respect to the direction of the axis CL1. The positions and size of the supports 31 to 34 are determined so as to satisfy the relational expressions $0.1 \leqq H \leqq 1.0$ and $L \geqq 1.5 \times H$.

Figure 7:
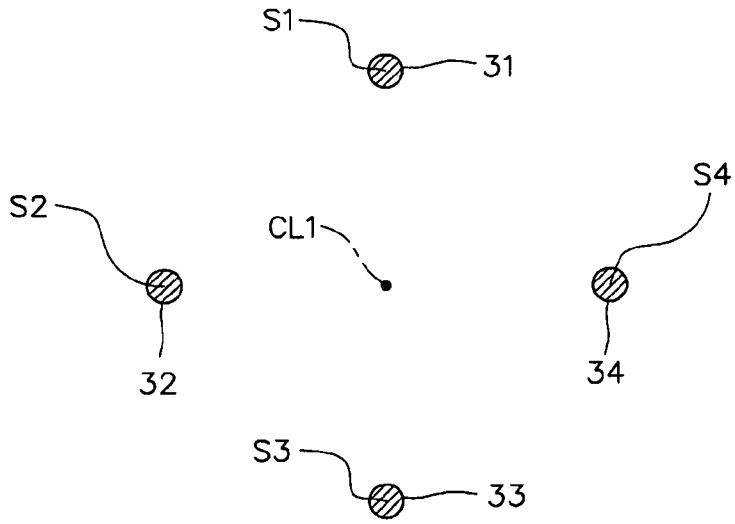
FIG. 7 is an end view of sections of the supports taken orthogonal to the axis at a position located 0.05 mm away along the axis from the front end surface of an insulator.

Furthermore, as shown in FIG. 7, S1 ($mm^2$), S2 ($mm^2$), S3 ($mm^2$), and S4 ($mm^2$) represent cross-sectional areas of the supports 31 to 34, respectively, taken orthogonally to the axis CL1 at respective positions located 0.05 mm away along the axis CL1 from the front end surface 2F of the insulator 2. The supports 31 to 34 are configured so as to satisfy the relational expression $S\ (=S1+S2+S3+S4) \geqq 0.04\ (mm^2)$.

Also, in the present embodiment, the ground electrode 27 is formed of W, Ir, Pt, Ni, or an alloy which contains at least one of the metals as a main component.

Next, a method of manufacturing the thus-configured ignition plug 1 is described.

First, the metallic shell 3 is formed beforehand. Specifically, a circular columnar metal material (e.g., an iron-based material, such as S17C or S25C, or a stainless steel material) is subjected to cold forging or the like for forming a through hole, thereby forming a general shape. Subsequently, machining is conducted so as to adjust the outline, thereby yielding the metallic shell 3.

Subsequently, the metallic shell 3 is subjected to zinc plating or nickel plating. In order to enhance corrosion resistance, the plated surface may be further subjected to chromate treatment.

Separately from preparation of the metallic shell 3, the insulator 2 is formed. For example, a forming material of granular substance is prepared by use of a material powder which contains alumina in a predominant amount, a binder, etc. By use of the prepared forming material of granular substance, a tubular green body is formed by rubber press forming. The thus-formed green body is subjected to grinding for shaping. The shaped green body is placed in a kiln, followed by firing. The fired body is subjected to various kinds of grinding, thereby yielding the insulator 2.

Separately from preparation of the metallic shell 3 and the insulator 2, the center electrode 5 is formed. Specifically, an Ni alloy prepared such that a copper alloy is disposed in a central portion thereof for enhancing heat radiation is subjected to forging, thereby forming the center electrode 5.

Then, the center electrode 5 and the terminal electrode 6 are fixed to the insulator 2 in a sealed condition by means of a glass seal layer 9. Specifically, the center electrode 5 is inserted into a front end portion of the axial bore 4. Then, a glass mixed powder (e.g., a mixture of borosilicate glass and a metal powder) which will become the glass seal layer 9 through firing is charged into the axial bore 4. Subsequently, the resultant assembly is heated in a kiln while the terminal electrode 6 is pressed forward from the rear side, thereby being fired and fixed. At this time, a glaze layer may be simultaneously fired on the surface of the rear trunk portion 10 of the insulator 2. Alternatively, the glaze layer may be formed beforehand.

Subsequently, the thus-formed insulator 2 having the center electrode 5 and the terminal electrode 6, and the thus-formed metallic shell 3 having the ground electrode 27 are fixed together. Specifically, the insulator 2 is inserted into the metallic shell 3. Then, a relatively thin-walled rear-end opening portion of the metallic shell 3 is crimped radially inward; i.e., the crimp portion 20 is formed, thereby fixing the insulator 2 and the metallic shell 3 together.

Furthermore, a metal material which contains W, Ir, etc., is subjected to sintering, electric discharge machining, etc., thereby yielding a rod material (wire rod). The rod material is subjected to forging, machining, electric discharge machining, etc., thereby forming the ground electrode 27 having the through hole portion 28. Also, a predetermined metal (e.g., an Ni alloy) is subjected to forging, etc., thereby forming the supports 31 to 34 having a hardness equal to or lower than that of a metal used to form the ground electrode 27. That is, the ground electrode 27 and the supports 31 to 34 are formed in such a manner as to satisfy the relational expression $Hi > Hg \geqq Hs$, where Hi (Hv) is the hardness (Vickers hardness) of the insulator 2, Hg (Hv) is the hardness of the ground electrode 27, and Hs (Hv) is the hardness of the supports 31 to 33. Each of the supports 31 to 34 has a circular columnar shape, so that the cross-sectional area thereof at a position located toward the insulator 2 is equal to that at a position located toward the ground electrode 27.

Next, in a joining step, the supports 31 to 34 are resistance-welded to the surface of the ground electrode 27 located on a side toward the insulator 2. Then, the ground electrode 27 is inserted into an opening of a front end portion of the metallic shell 3 until the supports 31 to 34 come into contact with the front end surface 2F of the insulator 2. In this condition, an outer circumferential portion of the ground electrode 27 is joined to the front end portion of the metallic shell 3 by laser welding or the like, thereby yielding the above-mentioned ignition plug 1. In the joining step, the force of inserting the ground electrode 27 into the metallic shell 3 may be varied for adjusting the amount of crush deformation of the supports 31 to 34 and, in turn, adjusting the aforementioned shortest distance H.

As described in detail above, according to the present embodiment, the supports 31 to 34 intervene between the front end surface 2F of the insulator 2 and the surface of the ground electrode 27 located on the side toward the insulator 2. Thus, heat of the ground electrode 27 can be efficiently transferred to the insulator 2. Therefore, overheat of the ground electrode 27 can be more reliably prevented, so that the occurrence of preignition can be restrained.

Also, by virtue of the gaps 35 formed between the supports 31 to 34, a space formed radially outward of the supports 31 to 34 and a space formed radially inward of the supports 31 to 34 (a space on a side toward the cavity 29) communicate with each other. Therefore, deposits which have entered the cavity 29 can be discharged to the space formed radially outward of the supports 31 to 34, whereby current leakage between the center electrode 5 and the ground electrode 27 can be reliably prevented.

Furthermore, in the present embodiment, the annular space 36 is formed radially inward of the supports 31 to 34 between the front end surface 2F of the insulator 2 and the surface of the ground electrode 27 located on the side toward the insulator 2. Also, by virtue of the existence of the supports 31 to 34, the ground electrode 27 can be disposed accurately at a desired position relative to the front end surface 2F of the insulator 2, whereby variation in the size of the space 36 can be effectively prevented. Therefore, even when electrically conductive substances, such as metal components of the center electrode 5, adhere to the wall surface of the axial bore 4, by virtue of the existence of the space 36, electrical insulation is reliably established between the center electrode 5 and the ground electrode 27. As a result, coupled with the effect that deposits can be discharged to the space formed radially outward of the supports 31 to 34, current leakage between the center electrode 5 and the ground electrode 27 can be effectively prevented. Therefore, plasma can be stably generated.

Additionally, according to the present embodiment, through generation of discharge along a path in gas across the space 36 (gaseous discharge), plasma can be generated without existence of obstruction to expansion of plasma. As a result, larger plasma can be generated, whereby ignition performance can be improved. That is, the provision of the space 36 contributes to both stable generation of plasma and improvement of ignition performance.

Also, according to the present embodiment, the aforementioned shortest distance H is specified to be 0.1 mm or more. Thus, even when electrically conductive substances adhere to the wall surface of the axial bore 4 in the course of use, electrical insulation can be more reliably established between the center electrode 5 and the ground electrode 27. Also, since the aforementioned shortest distance L is sufficiently large; specifically, 1.5 times or more the shortest distance H, current leakage which would otherwise creep on the inner circumferential surface and on the front end surface 2F of the insulator 2 between the center electrode 5 and the supports 31 to 34 can be more reliably prevented. As a result, plasma can be more reliably generated.

Also, since the aforementioned shortest distance H is specified to be 1.0 mm or less, discharge voltage required for generation of spark discharge can be sufficiently lowered. Thus, there can be restrained a phenomenon that spark discharges erode the inner circumferential surface of the insulator 2. Also, spark discharge can be more reliably generated.

Eventually, plasma can be more stably generated. Also, the employment of a shortest distance H of 1.0 mm or less restrains entry of generated plasma into the aforementioned space 36. Thus, the above-mentioned effect of improving ignition performance can be more reliably exhibited.

Furthermore, the gaps 35 are formed over a circumferential range of more than 50%; i.e., a space formed radially inward of the supports 31 to 34 and a space formed radially outward of the supports 31 to 34 communicate with each other over a wide circumferential range. Thus, deposits can be more effectively discharged to the space formed radially outward of the supports 31 to 34, so that current leakage can be more reliably prevented.

Also, the supports 31 to 34 collectively have a sufficiently large cross-sectional area S (=S1+S2+S3+S4) of 0.04 $mm^2$ or more as measured at respective positions located 0.05 mm away along the axis CL1 from the front end surface of the insulator 2. Thus, heat of the ground electrode 27 can be more efficiently transferred to the insulator 2 via the supports 31 to 34. As a result, the occurrence of preignition can be more reliably prevented.

Also, through employment of a cross-sectional area S of 0.04 $mm^2$ or more, in the course of manufacture of the ignition plug 1, when the supports 31 to 34 are brought into contact with the front end surface 2F of the insulator 2, a problematic situation that the distal end portions of the supports 31 to 34 are excessively crushed and deformed can be reliably prevented. As a result, the above-mentioned shortest distances H and L can be readily set to respectively desired values.

Additionally, since the aforementioned gaps 35 are provided at circumferentially equal intervals, deposits can be more effectively discharged to the space formed radially outward of the supports 31 to 34, so that current leakage can be more reliably prevented.

Also, since the supports 31 to 34 are formed integral with the ground electrode 27, misalignment of the supports 31 to 34 relative to the ground electrode 27 and to the insulator 2 can be prevented. As a result, the above-mentioned effect of improving leakage resistance, for example, can be more reliably exhibited.

Furthermore, since the ground electrode 27 is formed of a metal which contains at least one of W, Ir, etc., as a main component, erosion resistance of the ground electrode 27 against spark discharges or the like can be improved. As a result, an increase in discharge voltage associated with erosion of the ground electrode 27 can be restrained, whereby a period in which plasma can be generated can be elongated.

Also, according to the present embodiment, in the course of manufacture of the ignition plug 1, the joining step is performed after the assembling step. Thus, in the joining step, the position of the ground electrode 27 relative to the insulator 2 can be adjusted. Therefore, the supports 31 to 34 can be more reliably brought into contact with the front end surface 2F of the insulator 2, while breakage of the insulator 2 is prevented. As a result, the ignition plug 1 can be accurately manufactured, while a drop in yield is restrained.

Also, the hardness Hi of the insulator 2 is rendered higher than the hardness Hs of the supports 31 to 34. Thus, in a step of inserting the ground electrode 27 into the opening of the metallic shell 3, when the supports 31 to 34 impose a pressing force on the insulator 2, the insulator 2 is unlikely to suffer breakage, such as cracking. Furthermore, the hardness Hg of the ground electrode 27 is rendered equal to or higher than the hardness Hs of the supports 31 to 34. Thus, in the inserting step, the problem that the proximal ends of the supports 31 to 34 dig into the ground electrode 27 can be more reliably prevented. As a result, the breakage of the weld zones between the ground electrode 27 and the supports 31 to 34 can be restrained, so that misalignment of the supports 31 to 34 relative to the insulator 2 and to the ground electrode 27 can be more reliably prevented.

Additionally, before the joining step, the cross-sectional areas of the supports 31 to 34 as measured at respective positions located toward the insulator 2 are equal to the cross-sectional areas of the supports 31 to 34 as measured at respective positions located toward the ground electrode 27. Thus, when portions of the supports 31 to 34 in contact with the insulator 2 are crushed and deformed, excessive approach of the portions toward the cavity 29 is unlikely to arise. As a result, in a manufactured ignition plug 1, the aforementioned shortest distance L can assume a sufficiently large value, so that current leakage between the supports 31 to 34 and the center electrode 5 can be more reliably restrained.

Next, in order to verify actions and effects which the above-described embodiment yields, a plurality of ignition plug samples which differed in the shortest distance H while having a length of a creeping discharge path (creepage distance) of 1.0 mm or 2.0 mm were manufactured. The samples were subjected to an initial discharge voltage measuring test and to a leakage resistance evaluation test.

The initial discharge voltage measuring test is outlined below. The samples were mounted to a test chamber. While the pressure in the chamber was held at 0.4 MPa, discharge voltage required for spark discharge in the atmosphere (initial discharge voltage) was measured. In view of a gradual increase in discharge voltage with erosion of the center electrode and the fact that the higher the discharge voltage, the more likely channeling arises on the insulator, an initial discharge voltage of 20 kV or less is preferred.

The leakage resistance evaluation test is outlined below. The samples were mounted to a predetermined chamber. While the pressure in the chamber was held at 0.4 MPa, voltage with a frequency of 60 Hz was applied to the samples for generation of discharges, and current was applied to the samples from a plasma power supply having an output of 100 mJ for generation of plasma. After the elapse of 100 hours, the insulation resistance between the center electrode and the ground electrode was measured. When the insulation resistance drops to 10 MΩ or less, current leakage becomes likely to arise between the center electrode and the ground electrode, potentially resulting in hindrance to generation of plasma. Thus, in order to more reliably generate plasma, even in a condition that metal components of the center electrode adhere to the wall surface of the axial bore in association with erosion of the center electrode, it is preferred to secure an insulation resistance in excess of 10 MΩ.

Figure 8:
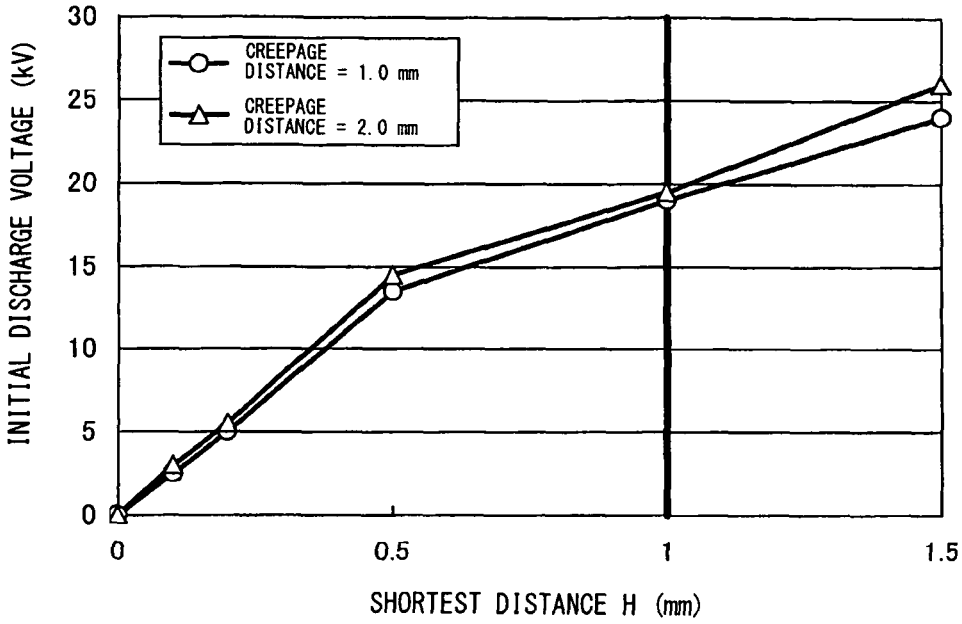
FIG. 8 is a graph showing the results of an initial discharge voltage measuring test on samples which differ in the shortest distance H.
Figure 9:
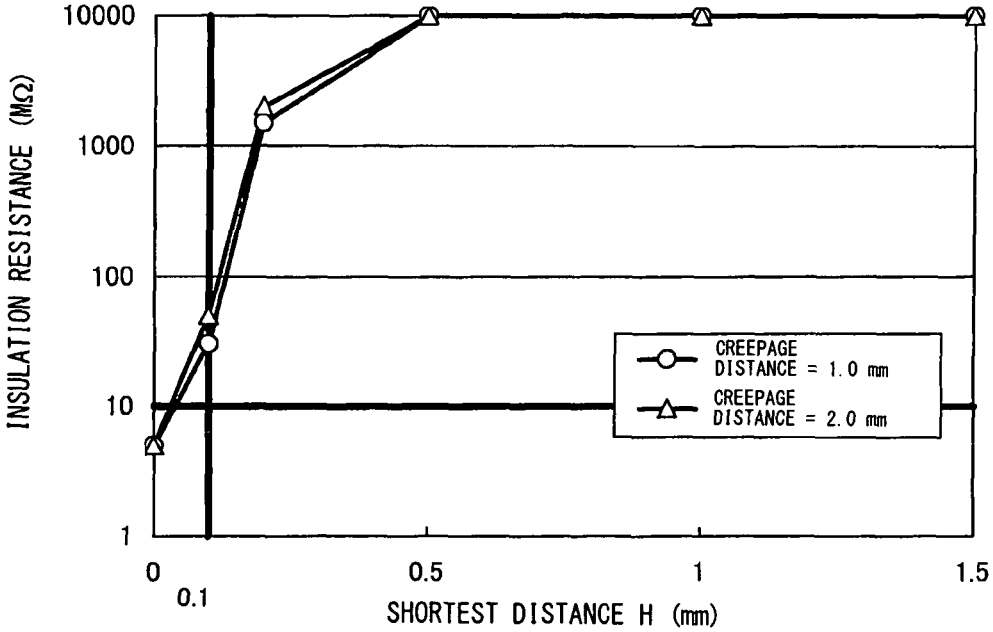
FIG. 9 is a graph showing the results of a leakage resistance evaluation test on samples which differ in the shortest distance H.

FIG. 8 shows the results of the initial discharge voltage measuring test. FIG. 9 shows the results of the leakage resistance test. In FIGS. 8 and 9, the test results of the samples having a creepage distance of 1.0 mm are plotted with circles, and the test results of the samples having a creepage distance of 2.0 mm are plotted with triangles. Also, in the samples, the shortest distance L was rendered 1.5 times the shortest distance H. Additionally, a shortest distance H of 0.0 mm means that the supports are not provided, so that the ground electrode is in contact with the front end surface of the insulator.

As shown in FIG. 8, it has been confirmed that the samples having a shortest distance H of 1.0 mm or less can have an initial discharge voltage of 20 kV or less irrespective of creepage distance.

Meanwhile, as shown in FIG. 9, it has been revealed that the samples having a shortest distance H of less than 0.1 mm exhibit an insulation resistance of 10 MΩ or less, indicating that current leakage is likely to occur. Conceivably, this is for the following reason. As a result of metal components of the center electrode adhering to the wall surface of the axial bore, the resistance of the creeping discharge path dropped sharply. Therefore, in the samples whose resistance of the gaseous discharge path is low by nature because of their shortest distance H of less than 0.1 mm, the insulation resistance, which is the total of the resistance of the gaseous discharge path and the resistance of the creeping discharge path, dropped markedly.

By contrast, the samples having a shortest distance H of 0.1 mm or more exhibited an insulation resistance in excess of 10 MΩ, indicating excellent leakage resistance.

Next, the ignition plug samples which differed in the shortest distance H and in the shortest distance L were manufactured. The samples were subjected to the above-mentioned leakage resistance test. Table 1 shows the test results. In Table 1, the samples which exhibited an insulation resistance in excess of 10 MΩ as measured after the elapse of 100 hours are marked with "Good," whereas the samples which exhibited an insulation resistance of 10 MΩ or less as measured after the elapse of 100 hours are marked with "Poor."

TABLE 1

| | | L (mm) | | | | | | | | | | | | | |
|---|---|---|---|---|---|---|---|---|---|---|---|---|---|---|---|
| | | 0.00 | 0.10 | 0.15 | 0.20 | 0.25 | 0.30 | 0.50 | 0.70 | 0.75 | 0.80 | 1.00 | 1.25 | 1.50 | 2.00 |
| H (mm) | 0.10 | Poor | Poor | Good | — | — | — | — | — | — | — | — | — | — | — |
| | 0.20 | — | — | — | Poor | poor | Good | — | — | — | — | — | — | — | — |
| | 0.50 | — | — | — | — | — | — | Poor | Poor | Good | — | — | — | — | — |
| | 1.00 | — | — | — | — | — | — | — | — | — | Poor | Poor | Poor | Good | Good |

As shown in Table 1, the samples whose shortest distance L is less than 1.5 times the shortest distance H exhibit an insulation resistance of 10 MΩ or less, indicating that current leakage is likely to arise. Conceivably, this is for the following reason. The length of the discharge path (corresponding to the shortest distance L) creeping on the front end surface of the insulator between the support and the opening of the axial bore was rendered excessively small as compared with the length of the gaseous discharge path (corresponding to the shortest distance H). In the resultant condition in which a spark discharge was likely to be generated along the path creeping on the surface of the insulator between the support and the center electrode, as a result of metal components of the center electrode adhering to the wall surface of the axial bore, the resistance of the path creeping on the surface of the insulator dropped sharply.

By contrast, the samples whose shortest distance L is 1.5 times or more the shortest distance H exhibit an insulation resistance in excess of 10 MΩ, indicating that the samples have sufficient leakage resistance.

As known from the above test results, in order to stably generate plasma while an excessive increase in initial discharge voltage is restrained, and sufficient leakage resistance is secured, preferably, the shortest distances H and L satisfy the relational expressions $0.1 \leqq H \leqq 1.0$ and $L \geqq 1.5 \times H$.

Figure 10:
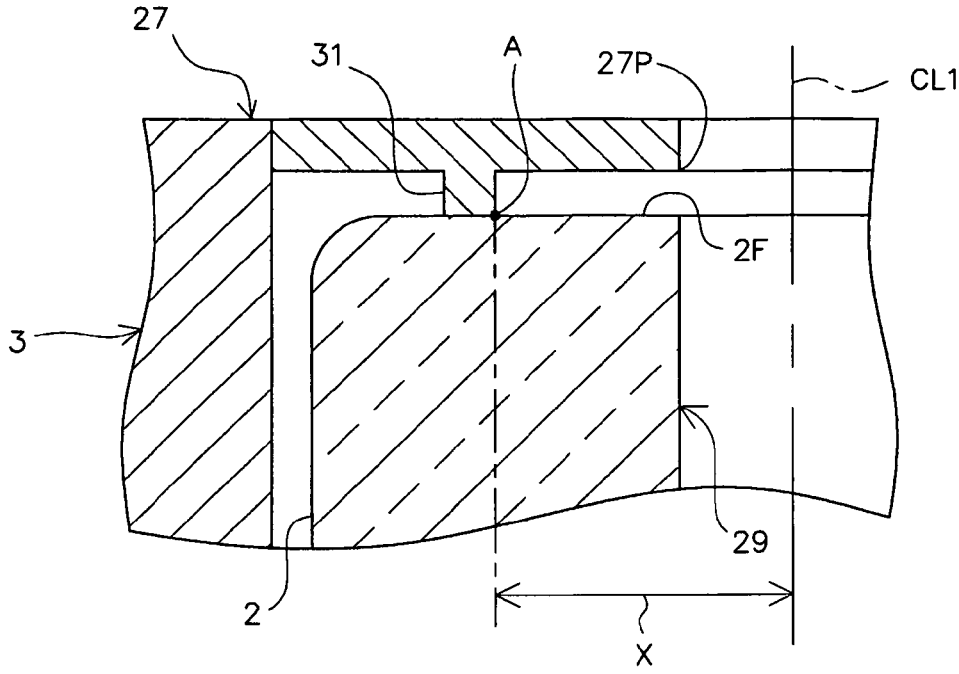
FIG. 10 is an enlarged, fragmentary, sectional view showing a front end portion of the ignition plug for explaining shortest distance X.
Figure 11:
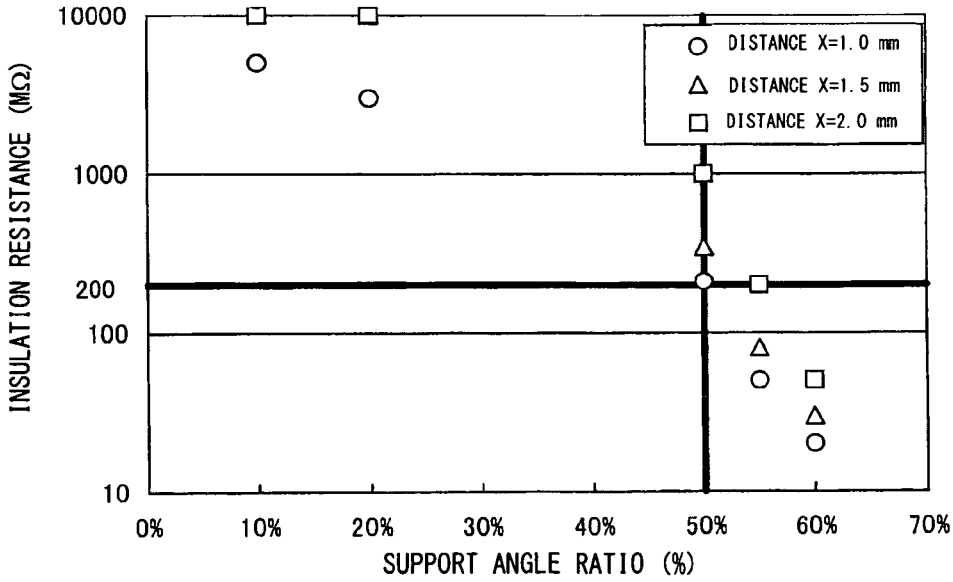
FIG. 11 is a graph showing the results of the leakage resistance evaluation test on samples which differ in support angular ratio.

Next, there were manufactured a plurality of ignition plug samples which had, as viewed on a section which contained the axis and the aforementioned point A, a shortest distance X between the axis and the point A (see FIG. 10) of 1.0 mm, 1.5 mm, or 2.0 mm and which differed in the aforementioned support angular ratio ($\alpha/360$) through variation in the size of the support. The samples were subjected to the above-mentioned leakage resistance test. FIG. 11 shows the results of the test. In FIG. 11, the test results of the samples having a distance X of 1.0 mm are plotted with circles; the test results of the samples having a distance X of 1.5 mm are plotted with triangles; and the test results of the samples having a distance X of 2.0 mm are plotted with squares. The samples were configured so as to satisfy the relational expressions $H \geqq 0.1$ (mm) and $L \geqq 1.5 \times H$.

As shown in FIG. 11, the samples had an insulation resistance in excess of 10 MΩ after the elapse of 100 hours. Particularly, the samples having a support angular ratio of 50% or less exhibited an insulation resistance of 200 MΩ or more after the elapse of 100 hours, indicating that the samples have excellent leakage resistance. Conceivably, this is for the following reason: by means of the support angular ratio having 50% or less. In other words, by means of the gaps between the supports being formed over a circumferential range of more than 50%, deposits are more likely to be discharged to a space located radially outward of the supports through the gaps. Also, particularly, the samples having a support angular ratio of 20% or less exhibited an insulation resistance in excess of 1,000 MΩ after the elapse of 100 hours, indicating that the samples have quite excellent leakage resistance.

As known from the above test results, in view of further improvement of leakage resistance, a support angular ratio ($\alpha/360$) of 0.5 (50%) or less is more preferred, and a support angular ratio of 0.2 (20%) or less is far more preferred.

Figure 12:
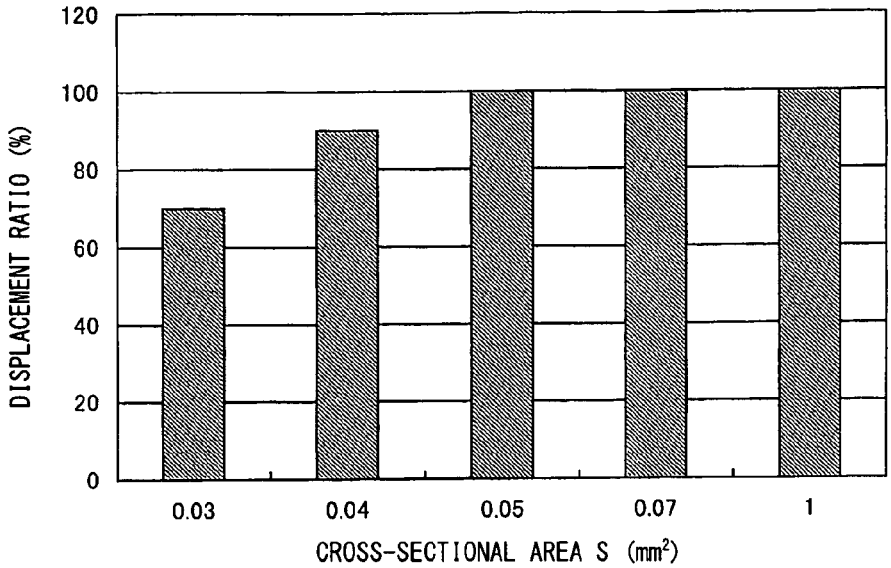
FIG. 12 is a graph showing the relationship between cross-sectional area S and the displacement ratio of the support.

Next, ground electrodes to which supports were joined were formed such that the supports differed in the cross-sectional area S ($mm^2$) as measured at respective positions located 0.05 mm away from their distal ends (which come into contact with the front end surface of the insulator) toward their proximal ends (toward the ground electrode). Each of the ground electrodes was inserted under a predetermined pressure into the opening of a front end portion of the metallic shell, and the displacement ratios of the supports were measured. FIG. 12 shows the relation between the cross-sectional area S and the displacement ratio. The displacement ratio means the ratio of the length (L2) of the support as measured after insertion to the length (L1) of the support as measured before insertion (L2/L1).

As shown in FIG. 12, the samples having a cross-sectional area S of less than 0.04 $mm^2$ exhibited relatively large amounts of deformation of the supports, indicating that the above-mentioned shortest distances H and L encounter difficulty in assuming respectively desired values. This is for the following reason: because of deterioration in strength of the supports, the supports are likely to be crushed and deformed at their distal ends.

By contrast, the samples having a cross-sectional area S of 0.04 $mm^2$ or more were almost free from deformation of the supports, indicating that the shortest distances H and L can more readily assume respectively desired values.

Next, there were manufactured ignition plug samples which had circular columnar or hemispheric supports and differed in the aforementioned cross-sectional area S ($mm^2$).

The cross-sectional area S was varied by means of varying the support diameter. The samples were subjected to a preignition resistance evaluation test. The preignition resistance evaluation test is outlined below. The samples were mounted to the 1.6 L, 4-cylinder DOHC engine. The engine was operated with full throttle opening (5,500 rpm) for two minutes. Subsequently, the samples were inspected to see whether or not preignition occurred. In the case where preignition did not occur, ignition angle was advanced by one degree, and the engine was again operated with full throttle for two minutes. This procedure was repeated until preignition occurred, thereby obtaining an ignition angle (° C.A) upon occurrence of preignition.

Figure 13:
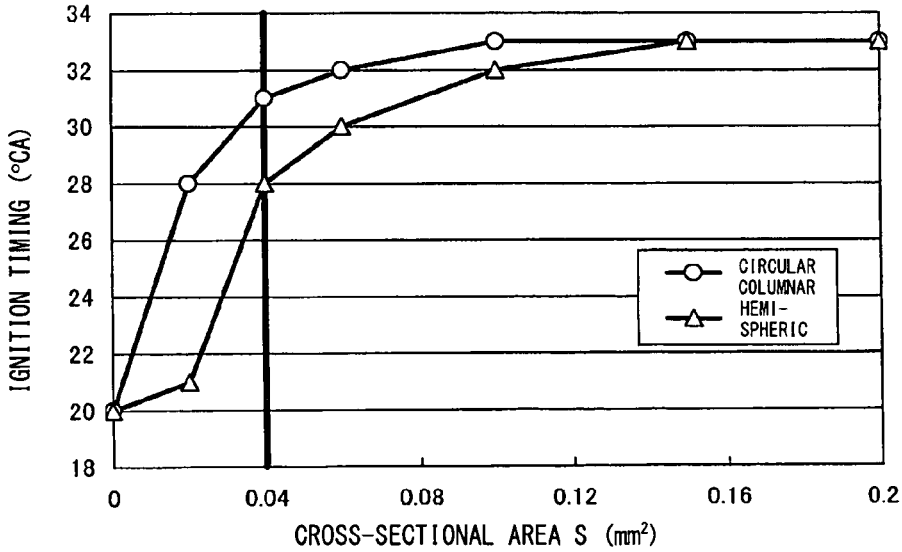
FIG. 13 is a graph showing the results of a preignition resistance evaluation test on samples which differ in cross-sectional area S.

The more the ignition angle is advanced, the greater amount of heat a sample receives. The more the ignition angle is delayed, the smaller amount of heat a sample receives. Also, the greater the amount of heat received by a sample, the more likely the temperature of the sample is to increase Thus, the more likely preignition is to occur. Therefore, the greater the ignition angle of a sample at the time of occurrence of preignition, the more efficiently the sample can transfer received heat to the insulator, indicating that the sample has excellent preignition resistance. FIG. 13 shows the results of the preignition resistance evaluation test. In FIG. 13, the test results of the samples having circular columnar supports are plotted with circles, and the test results of the samples having hemispheric supports are plotted with triangles.

As shown in FIG. 13, as compared with the samples having a cross-sectional area S of less than 0.04 $mm^2$, the samples having a cross-sectional area S of 0.04 $mm^2$ or more exhibit a drastic increase in ignition angle, indicating the samples have quite excellent preignition resistance. Conceivably, this is for the following reason. Even though a portion of the support which falls within a range of 0.05 mm from the distal end of the support toward the proximal end of the support is not in contact with the insulator, the portion of the support transfers heat to the insulator in the form of radiation heat. Coupled with this feature, through employment of a sufficiently large cross-sectional area S of 0.04 $mm^2$ or more, heat of the ground electrode is efficiently transferred to the insulator via the support. Eventually, the occurrence of preignition with the ground electrode serving as a heat source is effectively restrained.

As known from the above test results, in order to reliably prevent both deformation of the supports in the course of manufacture and overheat of the ground electrode, the cross-sectional area S is preferably 0.04 $mm^2$ or more.

The present invention is not limited to the above-described embodiment, but may be embodied, for example, as follows. Of course, applications and modifications other than those exemplified below are also possible.

Figure 14:
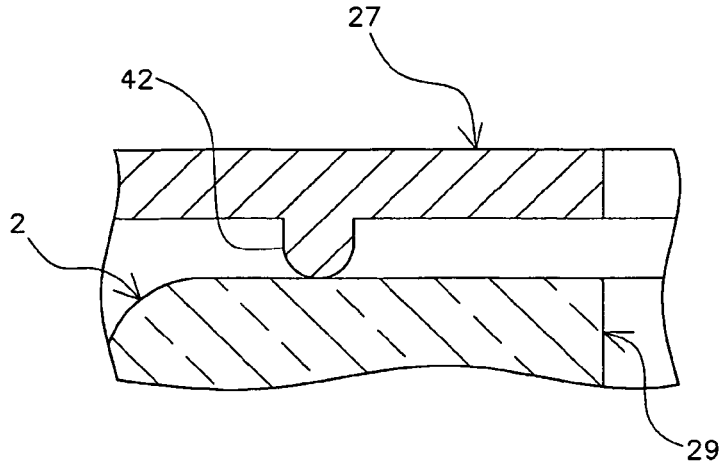
FIG. 14 is an enlarged, fragmentary, sectional view showing a support in another embodiment of the present invention.
Figure 15:
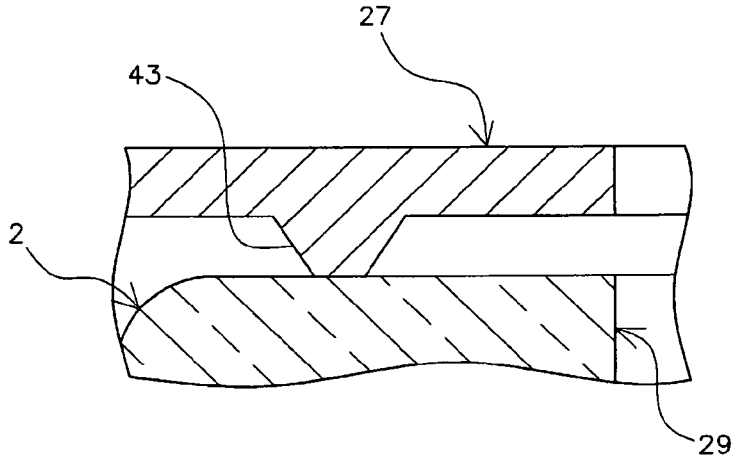
FIG. 15 is an enlarged, fragmentary, sectional view showing a support in a further embodiment of the present invention.
Figure 16:
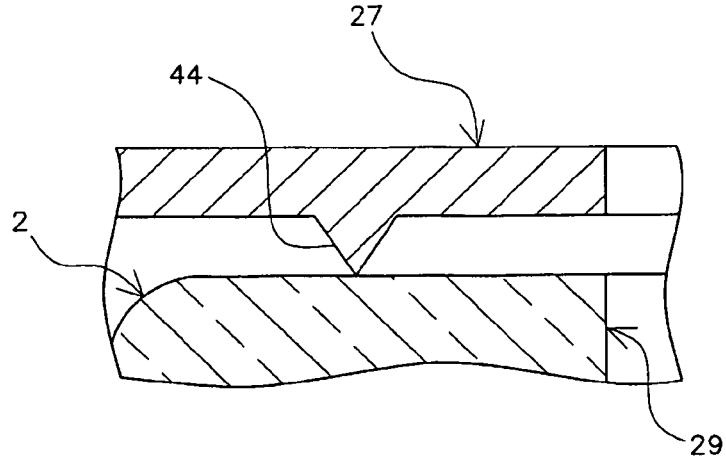
FIG. 16 is an enlarged, fragmentary, sectional view showing a support in a still further embodiment of the present invention.

(a) In the above-described embodiment, the supports 31 to 34 each assume a circular columnar form and thus have a cross-sectional area which is uniform along the direction of the axis CL1. However, the support may have a cross-sectional area which varies along the direction of the axis CL1. Thus, for example, as shown in FIGS. 14 to 16, as viewed on a section which contains the axis CL1, supports 42, 43, and 44 may be formed such that at least portions thereof located toward the insulator 2 have a hemispheric cross section, a trapezoidal cross section, and a triangular cross section, respectively. That is, the supports 42 to 44 may be formed such that, before the ground electrode 27 is joined to the metallic shell 3, portions of the supports 42 to 44 located toward the insulator 2 are smaller in cross-sectional area than portions of the supports 42 to 44 located toward the ground electrode 27. In this case, in the joining step, even though distal end portions (portions located toward the insulator 2) of the supports 42 to 44 are crushed and deformed to some extent, excessive approach of the distal end portions toward the cavity 29 is unlikely to arise, whereby current leakage between the center electrode 5 and the supports 42 to 44 can be more reliably restrained.

Figure 17A:
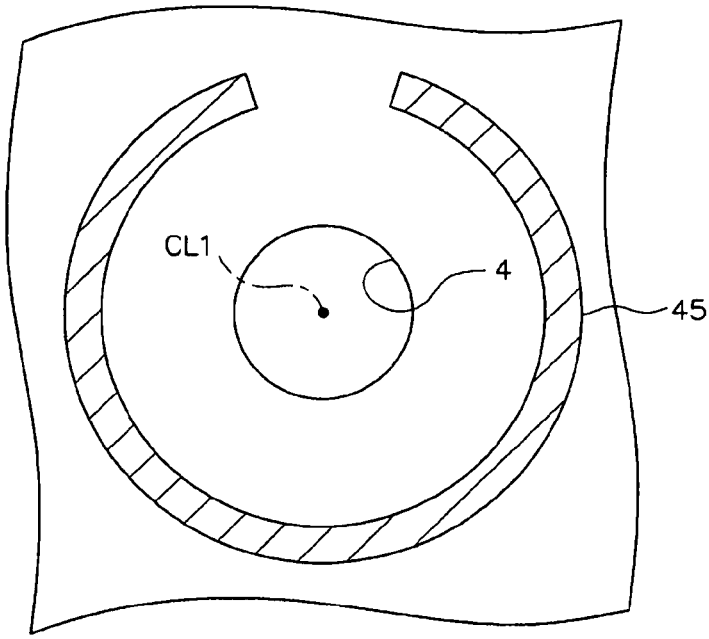
FIG. 17A is an enlarged, fragmentary, sectional view showing a support in yet another embodiment of the present invention.
Figure 17B:
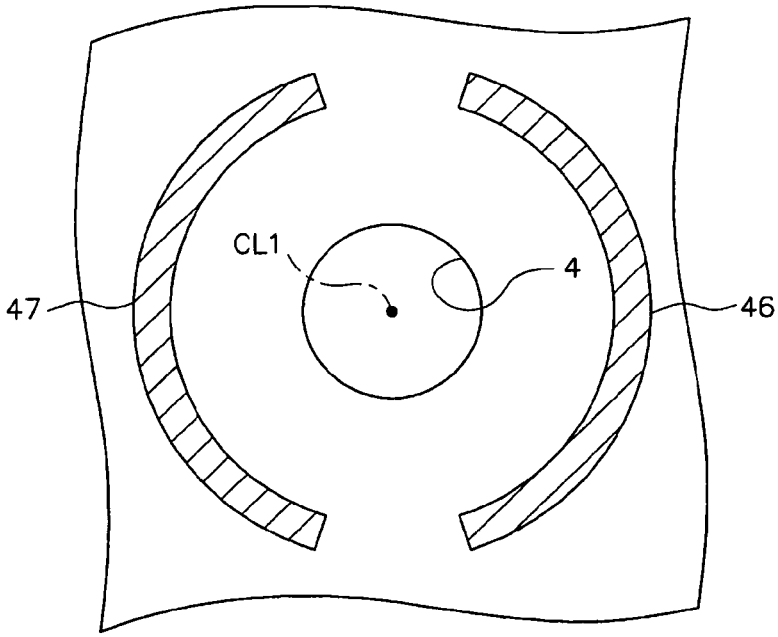
FIG. 17B is an enlarged, fragmentary, sectional view showing supports in another embodiment of the present invention.
Figure 18:
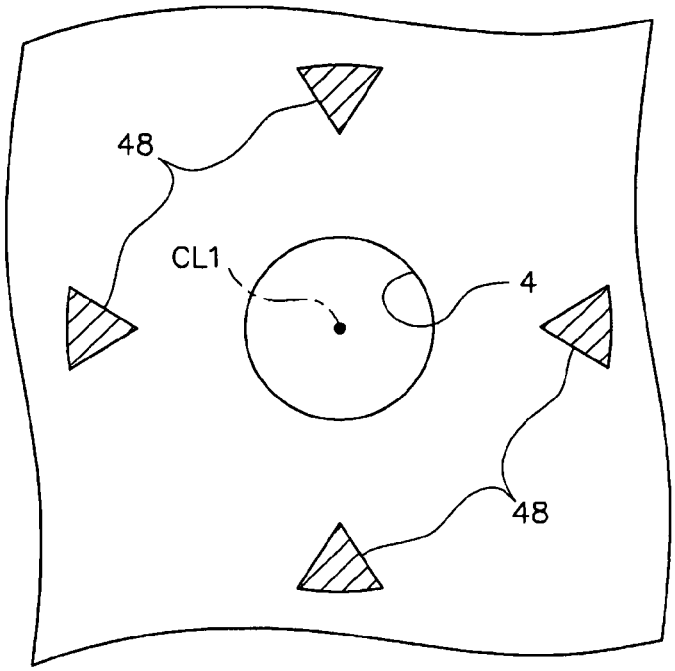
FIG. 18 is an enlarged, fragmentary, sectional view showing supports in a further embodiment of the present invention.

(b) In the above-described embodiment, four supports 31 to 34 are provided. However, the number of supports is not limited thereto. Also, the supports 31 to 34 each have a circular cross section. However, no particular limitation is imposed on the cross-sectional shape of the support. Thus, for example, as shown in FIG. 17A, only a single support 45 having a C-shaped cross section may be provided, or, as shown in FIG. 17B, two supports 46 and 47 may be provided. Also, as shown in FIG. 18, supports 48 may each have a triangular cross section.

Figure 19:
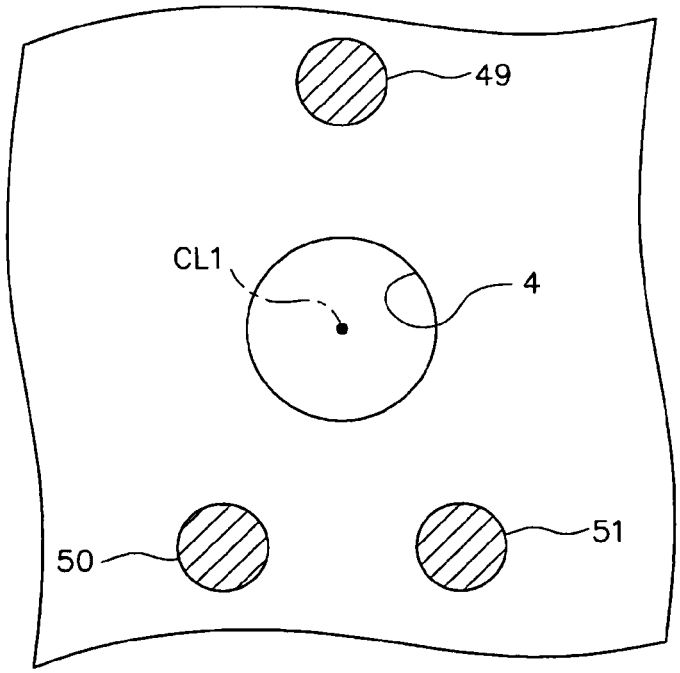
FIG. 19 is an enlarged, fragmentary, sectional view showing supports in a still further embodiment of the present invention.

(c) In the above-described embodiment, the supports 31 to 34 are provided at circumferentially equal intervals. However, as shown in FIG. 19, supports 49, 50, 51 may be provided at circumferentially unequal intervals.

(d) In the above-described embodiment, the supports 31 to 34 are welded to the ground electrode 27, whereby the ground electrode 27 and the supports 31 to 34 are formed integral with one another. However, the ground electrode 27 and the support(s) may be formed integral with each other by the following method: a predetermined jig (not shown) having a recess(es) is pressed against the ground electrode 27 so as to form the support(s) through extrusion.

Figure 20:
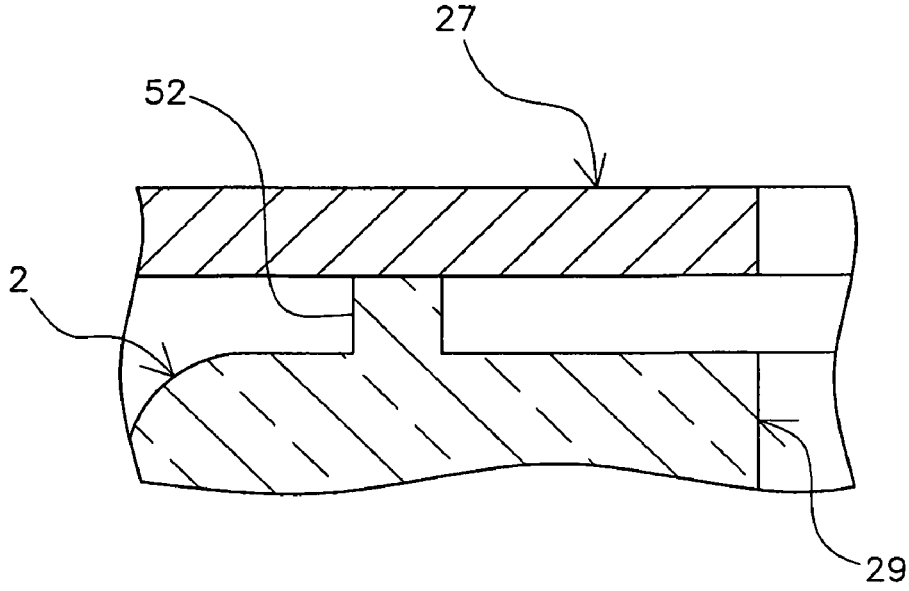
FIG. 20 is an enlarged, fragmentary, sectional view showing a support in another embodiment of the present invention.

Also, instead of forming the ground electrode 27 and the support integral with each other, as shown in FIG. 20, the insulator 2 and a support 52 may be formed integral with each other. In forming the support 52 integral with the insulator 2, in view of easiness of working, preferably, the support 52 is formed before the insulator 2 is subjected to firing (that is, the support 52 is formed integral with a relatively soft green body of the insulator before subjection to firing).

Figure 21:
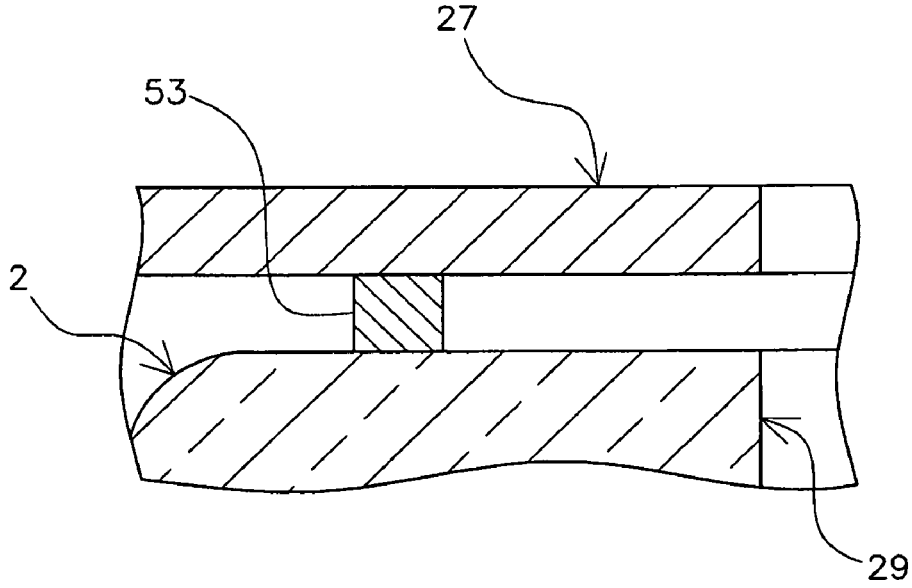
FIG. 21 is an enlarged, fragmentary, sectional view showing a support in a further embodiment of the present invention.
Figure 22A:
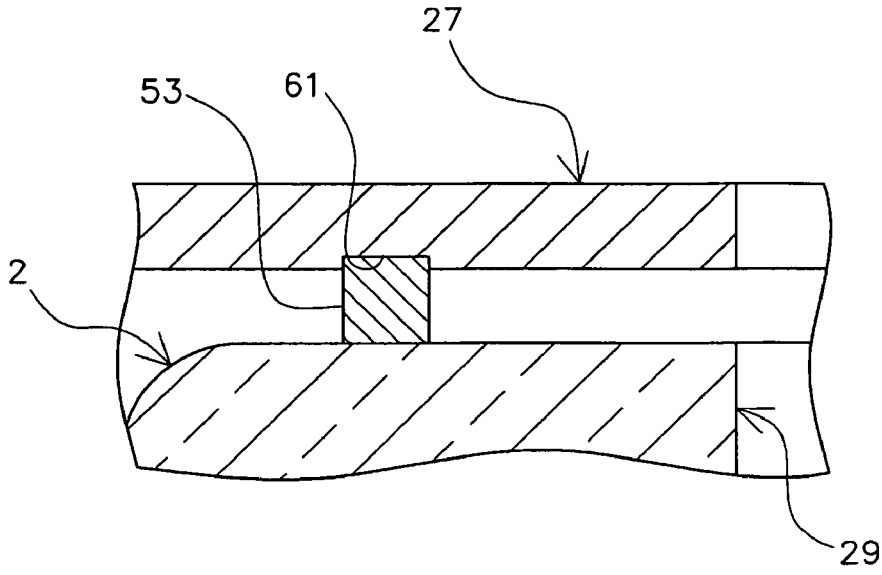
FIG. 22A is an enlarged, fragmentary, sectional view showing a recess in a still further embodiment of the present invention.
Figure 22B:
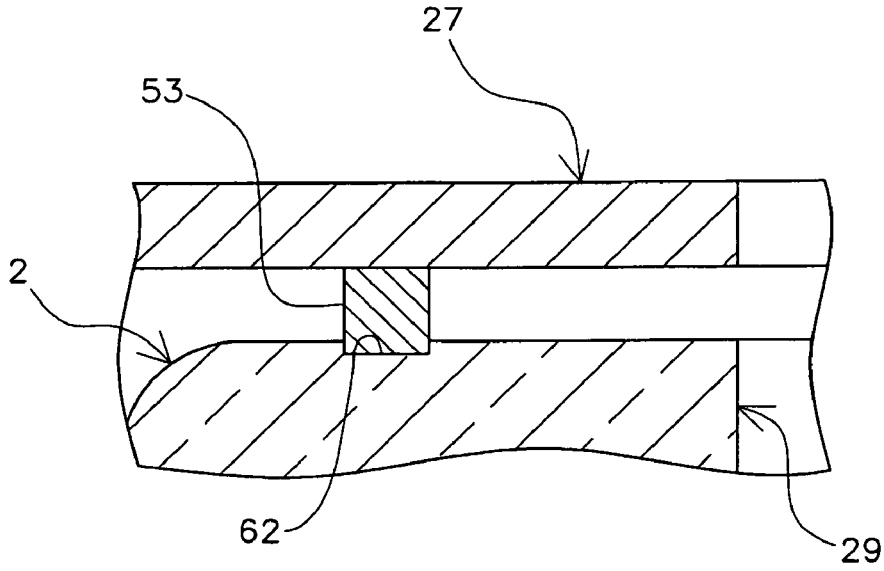
FIG. 22B is an enlarged, fragmentary, sectional view showing a recess in yet another embodiment of the present invention.

Furthermore, as shown in FIG. 21, a support 53 may be provided separately from the ground electrode 27 and the insulator 2. In this case, as shown in FIGS. 22A and 22B, the movement of the support 53 relative to the ground electrode 27 and to the insulator 2 may be restricted by the following method: recesses 61 and 62 are provided on the surface of the ground electrode 27 located on a side toward the insulator 2 and on the front end surface 2F of the insulator 2, respectively, and the support 53 is fitted to the recess 61 or 62. In this case, even though the support 53 is provided separately from the ground electrode 27 and the insulator 2, misalignment of the support 53 relative to the ground electrode 27 and to the insulator 2 can be restrained.

(e) In the above-described embodiment, the ground electrode 27 is formed of W, Ir, or a like metal. However, in the ground electrode 27, only an inner circumferential portion susceptible to erosion associated with spark discharges may be formed of W, Ir, or a like metal.

(f) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

Description of Reference Numerals

| | |
|---|---|
| 1: | plasma jet ignition plug (ignition plug); |
| 2: | insulator; |

-continued

| Description of Reference Numerals | |
|---|---|
| 3: | metallic shell; |
| 4: | axial bore; |
| 5: | center electrode; |
| 27: | ground electrode; |
| 28: | through hole portion; |
| 29: | cavity; |
| 31, 32, 33, 34: | support; |
| CL1: | axis |

Having described the invention, the following is claimed:

1. A plasma jet ignition plug comprising:

an insulator having an axial bore extending in a direction of an axis;

a center electrode inserted in the axial bore in such a manner that a front end thereof is located rearward of a front end of the insulator with respect to the direction of the axis;

a metallic shell disposed externally of an outer circumference of the insulator; and a ground electrode fixed to a front end portion of the metallic shell and disposed frontward of the front end of the insulator with respect to the direction of the axis;

a cavity being defined by a wall surface of the axial bore and a front end surface of the center electrode; and the ground electrode having a through hole portion for allowing the cavity to communicate with an ambient atmosphere;

the plasma jet ignition plug further comprising a support intervening between a front end surface of the insulator and a surface of the ground electrode located on a side toward the insulator;

wherein a space formed radially outward of the support and a space formed radially inward of the support communicate with each other, and as viewed on an imaginary plane which is orthogonal to the axis and onto which an opening of the axial bore located on a front side with respect to the direction of the axis and the support are projected, a point A which is on an outline of the support such that a distance to the axis therefrom is the shortest distance between the outline of the support and the axis is located radially outward of an outline of the opening of the axial bore.

2. A plasma jet ignition plug according to claim 1, wherein, when the support is projected along the axis onto a plane orthogonal to the axis, as viewed on the plane of projection, two straight lines being tangent to the projected support and passing the axis form an angle $\alpha(°)$ therebetween on a side toward the projected support, and the angle $\alpha$ satisfies a relational expression $\alpha/360° \leqq 0.5$.

3. A plasma jet ignition plug according to claim 1, wherein the ground electrode, the support, and the insulator are in such a positional relation that, as viewed on a section which contains the axis and the point A, relational expressions $0.1 \leqq H \leqq 1.0$ and $L \geqq 1.5 \times H$ are satisfied, where H (mm) is the shortest distance between the front end surface of the insulator and a point closest to the axis on the surface of the ground electrode located on the side toward the insulator, and L (mm) is the shortest distance between the point A and the opening of the axial bore located on the front side with respect to the direction of the axis.

4. A plasma jet ignition plug according to claim 1, wherein the support satisfies a relational expression $S \geqq 0.04$, where S ($mm^2$) is a cross-sectional area of the support taken orthogonally to the axis at a position located 0.05 mm away along the axis from the front end surface of the insulator.

5. A plasma jet ignition plug according to claim 1, wherein a plurality of the supports are provided.

6. A plasma jet ignition plug according to claim 5, wherein the supports are provided at circumferentially equal intervals.

7. A plasma jet ignition plug according to claim 1, wherein the ground electrode is formed of tungsten, iridium, platinum, nickel, or an alloy which contains at least one of the metals as a main component.

8. A plasma jet ignition plug according to claim 1, wherein the support(s) is formed integral with the ground electrode or with the insulator.

9. A method of manufacturing a plasma jet ignition plug comprised of an insulator having an axial bore extending in a direction of an axis; a center electrode inserted in the axial bore in such a manner that a front end thereof is located rearward of a front end of the insulator with respect to the direction of the axis; a metallic shell disposed externally of an outer circumference of the insulator; and a ground electrode fixed to a front end portion of the metallic shell and disposed frontward of the front end of the insulator with respect to the direction of the axis; a cavity being defined by a wall surface of the axial bore and a front end surface of the center electrode; and the ground electrode having a through hole portion for allowing the cavity to communicate with an ambient atmosphere; the plasma jet ignition plug further comprising a support intervening between a front end surface of the insulator and a surface of the ground electrode located on a side toward the insulator; wherein a space formed radially outward of the support and a space formed radially inward of the support communicate with each other, and as viewed on an imaginary plane which is orthogonal to the axis and onto which an opening of the axial bore located on a front side with respect to the direction of the axis and the support are projected, a point A which is on an outline of the support such that a distance to the axis therefrom is the shortest distance between the outline of the support and the axis is located radially outward of an outline of the opening of the axial bore, said method comprising:

an assembling step of assembling the insulator and the metallic shell together, and a joining step of joining the ground electrode to the front end portion of the metallic shell, wherein the joining step is performed after the assembling step.

10. A method of manufacturing a plasma jet ignition plug according to claim 9, wherein the joining step comprises:

a step of joining the support(s) to the surface of the ground electrode located on the side toward the insulator and a step of inserting the ground electrode into an opening formed in a front end portion of the metallic shell until the support(s) comes into contact with the front end surface of the insulator, and then joining the ground electrode to the front end portion of the metallic shell; and a relational expression $Hi > Hg \geqq Hs$ is satisfied, where Hi is hardness of the insulator, Hg is hardness of the ground electrode, and Hs is hardness of the support(s).

11. A method of manufacturing a plasma jet ignition plug according to claim 9, wherein the joining step comprises:

a step of forming the support(s) on the surface of the ground electrode located on the side toward the insulator and a step of inserting the ground electrode into an opening formed in a front end portion of the metallic shell until the support(s) comes into contact with the front end surface of the insulator, and then joining the ground electrode to the front end portion of the metallic shell; and before the joining step, a cross-sectional area of the support (s) as measured at a position located toward the insulator is equal to or smaller than a cross-sectional area of the support(s) as measured at a position located toward the ground electrode.

* * * * *